United States Patent [19]

Kapel

[11] 4,398,305

[45] Aug. 16, 1983

[54] FOLDABLE CAP CONSTRUCTION

[76] Inventor: Henry R. Kapel, 12655 Coit Rd., Cleveland, Ohio 44108

[21] Appl. No.: 258,570

[22] Filed: Apr. 29, 1981

[51] Int. Cl.[3] ..... A42B 1/02; A42B 1/04

[52] U.S. Cl. ..... 2/195; 2/197

[58] Field of Search ..... 2/195, 175, 209.5, 197, 2/200

[56] References Cited

U.S. PATENT DOCUMENTS

| | | | |
|---|---|---|---|
| 2,990,552 | 7/1961 | De Villers | 2/195 |
| 3,082,430 | 3/1963 | Wagenfeld | 2/197 |
| 3,292,183 | 12/1966 | Story | 2/195 UX |
| 3,348,239 | 10/1967 | Lamour | 2/197 |
| 4,068,319 | 1/1978 | Wagenfeld | 2/197 |

*Primary Examiner*—Doris L. Troutman

*Attorney, Agent, or Firm*—Gerald S. Geren

[57] ABSTRACT

An improved disposable head covering, such as a chef's hat, includes a peripheral cylindrical wall having opposed end sections. The wall is defined by an inner liner and a corrugated sheet adhesively secured to the outer surface of the liner. A shape-sustaining crown member is fastened to the upper end section of the wall, while the lower end section thereof remains unobstructed to receive the head of a user. The crown member is a generally circular disc. The disc includes a scored diameter which serves to (a) bisect the disc into two segments and (b) facilitate folding of the disc between a collapsed condition and a shape-sustaining condition. Preferably the disc further includes tab members and cut-out members positioned along the scored diameter thereof. The tab members and cut-out members are correspondingly shaped and sized so that the tab member of one disc segment frictionally engages the cut-out member of the other disc segment when the crown member is in the shape-sustaining condition. The shape-sustaining crown member is thereby folded upon itself when the head covering is collapsed for storage and shipment, and the crown member is frictionally retained in a generally planar condition to maintain the shape of the cylindrical wall when the head covering is worn by the user.

4 Claims, 4 Drawing Figures

FIG. 1
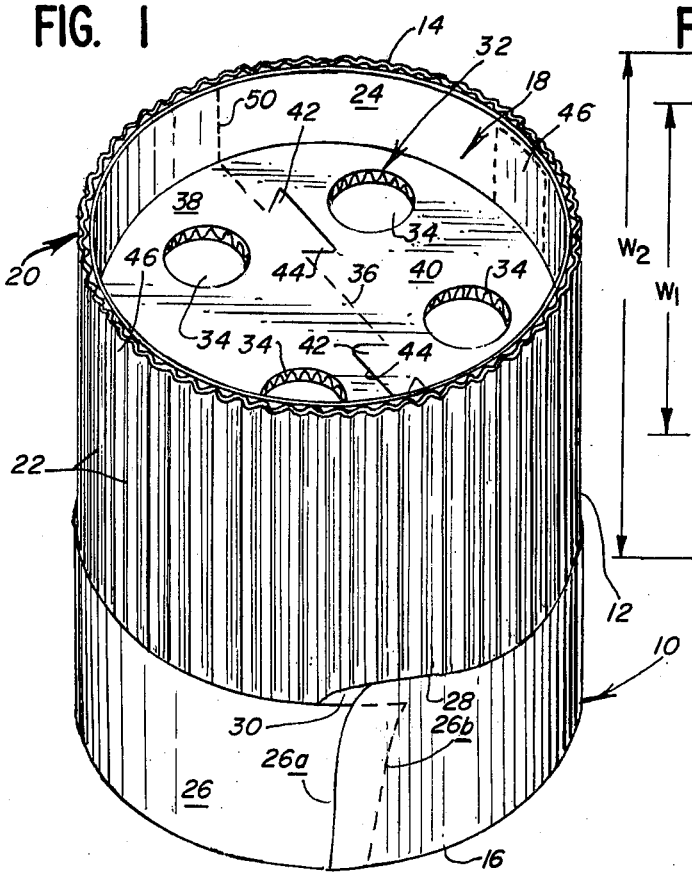
FIG. 2
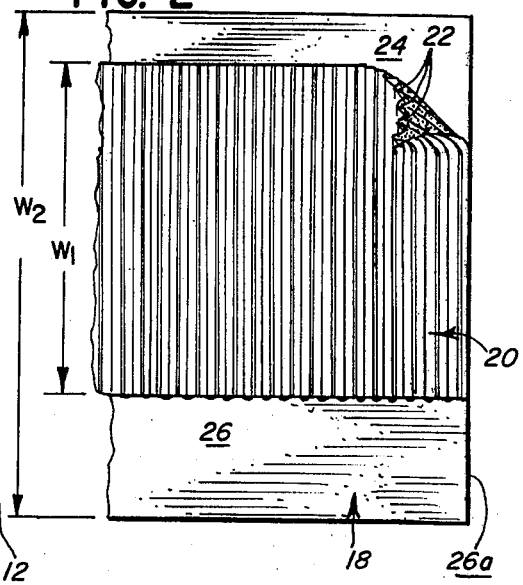
FIG. 3
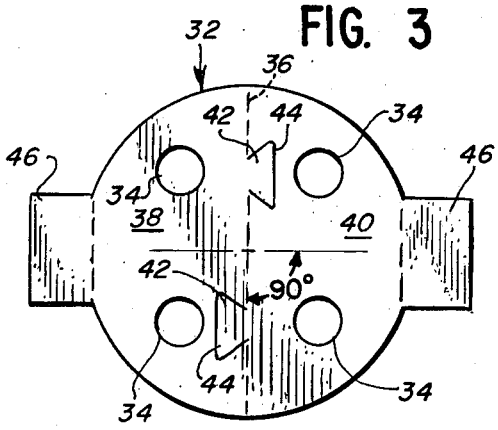
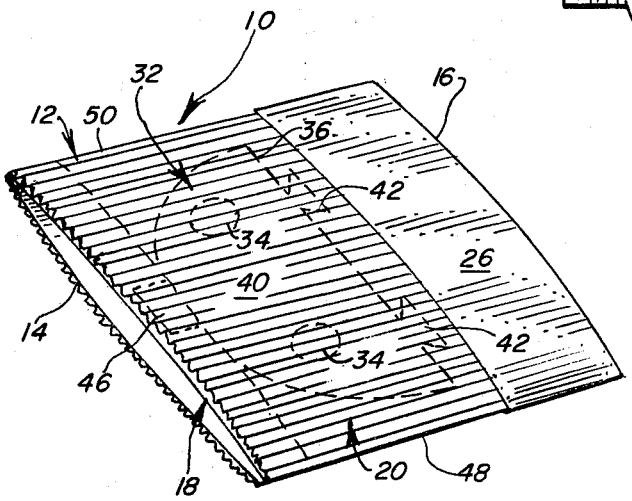
FIG. 4

FOLDABLE CAP CONSTRUCTION

FIELD OF THE INVENTION

This invention relates generally to disposable head coverings and more particularly to a cylindrically shaped, disposable head covering which includes an improved crown member for frictionally maintaining the cylindrical shape of the head covering.

BACKGROUND OF THE INVENTION

Health and sanitation laws require the use of head coverings by people engaged in the public preparation and serving of consumable food and beverages. In order to abide by said laws and economically provide head coverings in an industry plagued by the rapid turnover of help, restaurant owners now use disposable head coverings, i.e., hats fabricated from paper or inexpensive cloth-like materials. Restauranteurs have discovered that by buying bulk quantities of disposable head coverings, costs are kept at an affordable level.

One type of disposable head covering is a pleated longitudinally elongated, cylindrically shaped hat, popularly called a "chef's cap". The chef's cap is provided with an upper closure member such as a disc-like crown member permanently glued or otherwise secured to the upper portion of the elongated chef's cap. Such a disposable chef's cap with a shape-sustaining crown member is disclosed by U.S. Pat. No. 4,068,319.

Since it is desirable to ship the caps from the factory to the customer in an assembled condition, the caps must be foldable for transit and storage and must be able to sustain the cylindrical shape of the cap when the customer is ready to use same. Prior art devices have recognized the availability of the crown member to perform a shape-sustaining function. However, it has been found that the shape-sustaining crown members of prior art caps which have either (a) been stored in a folded condition for long periods of time, or (b) been repeatedly folded and unfolded, lose the ability to maintain the cylindrical shape of the caps.

It is therefore the principal object of the present invention to provide a collapsible, disposable head covering which includes a shape-sustaining crown member wherein the ability of said crown member to maintain the circular shape of the cylindrical portion of the cap is not lost due to either (a) prolonged periods of storage in a folded condition, or (b) repeated folding and unfolding of the crown member.

It has also been determined that prior art chef's caps which relied on pleated cylindrical walls (a) lack sufficient rigidity to retain the cylindrical shape of the cap throughout the length thereof and (b) are expensive to manufacture.

It is therefore a further object of the present invention to provide a shape-sustaining crown member for a disposable, cylindrically-shaped head covering wherein the longitudinal rigidity of the cylindrical wall is reinforced by providing an inexpensive corrugated sheet adhesively secured to an inner liner.

These and other objects and advantages of the present invention will become apparent to one ordinarily skilled in the art from the following description of a preferred embodiment of the invention as illustrated in the accompanying drawings and as more fully disclosed in the specification and claims which follow.

SUMMARY OF THE INVENTION

Described herein is a longitudinally elongated, disposable head covering which is formed by a peripheral, cylindrical wall having opposed end sections. A shape-sustaining crown member is secured to the upper end section of the cylindrical wall while the lower end section of said wall is unobstructed for receiving the head of a user. A primary feature of this invention is the construction of the shape-sustaining crown member. Said member is formed as a generally circularly shaped disc which is scored along a diameter thereof. The scored diameter bisects the disc into two segments and facilitates folding of said disc between a collapsed condition for storage and shipment of the head covering and a generally planar condition for maintaining the shape of the head covering when same is to be worn. The disc preferably includes correspondingly shaped and sized tab members and cut-out members which are so positioned along the scored diameter of the disc that the tab member of one disc segment is adapted to frictionally engage the cut-out member of the other disc segment when the crown member is in its shape-sustaining condition. The head covering is thus constructed so the shape-sustaining crown member thereof may be folded upon itself when the head covering is collapsed for storage and shipment, and the shape-sustaining crown member may be restored to a generally planar condition wherein the tab members of one disc segment frictionally engage the cut-out members of the other disc segment to maintain the cylindrical shape of the head covering when the head covering is to be worn.

In the preferred embodiment, the cylindrically shaped wall of the head covering is formed by an inner liner which has a corrugated sheet adhesively secured to the outer surface thereof. The crown member includes two radial tab-like projections which are provided to secure the crown member to the upper end section of the cylindrical wall of the head covering. The projections lie at the opposite ends of the diameter of the crown member, the diameter being perpendicular to the scored diameter thereof, whereby the projections may be secured to the cylindrical wall of the head covering without interfering with folding of the head covering.

BRIEF DESCRIPTION OF THE DRAWINGS

FIG. 1 is a perspective view of the cylindrically-shaped, disposable head covering of the present invention showing the crown member in the shape-sustaining condition;

FIG. 2 is a fragmentary top plan view of a section of the cylindrical wall of the head covering of FIG. 1 depicting the corrugated sheet adhesively secured to the paper liner;

FIG. 3 is a top plan view of the shape-sustaining crown member of the head covering of FIG. 1; and FIG. 4 is a perspective view of the head covering of FIG. 1 showing the crown member in phantom and illustrating the crown member, in particular, and the head covering, generally, in the folded condition.

DETAILED DESCRIPTION OF THE INVENTION

Referring now to the drawings, and particularly to FIG. 1, the disposable head covering of the present invention is indicated generally by the reference numeral 10. The head covering 10 is of the type generally known as a "chef's cap" and comprises a longitudinally elongated, generally cylindrical wall or body 12 having an upper end section 14 and an oppositely disposed lower end section 16.

The cylindrical wall 12 of the head covering 10 is formed by an inner liner 18, best shown in FIG. 2. Adhesively secured to the outer surface of the liner 18 is a heavier gauge corrugated paper 20. The ridges 22 of the corrugated paper 20 serve to rigidify the cylindrical wall 12 thereby maintaining the upright appearance of the head covering. The width $w_1$, of the corrugated paper is substantially less than the width, $w_2$, of the liner 18 so as to form, when the corrugated paper 20 is adhesively secured to the liner 18, an upper bead 24 and a lower headband 26. The upper bead 24 is folded back and secured, preferably by adhesive, to the inner surface of the liner 18 to permanently fix the circumference of the upper end 14 of the cylindrical wall 12 at a predetermined size. The lower headband 26 is folded over so as to lie atop the corrugated side of the liner 18. The top portion of the lower headband 22 is doubled upon itself along fold line 28 to provide the visible portion of the headband 26 and an inwardly turned panel 30. Opposite ends of the headband 26 are defined by freely extending edges 26*a* and 26*b*. By threading the edge 26*b* of the headband 26 into the pocket formed between panel 30 and the visible portion of said headband 26, a telescoping fit is provided which enables said lower headband 26 to be telescopically adjusted to the head of the user.

While one method of forming (a) the cylindrical wall 12 of the head covering 10 and (b) the adjustable headband 26 thereof has been described, other methods could be used without departing from the spirit and scope of the present invention. For instance, snaps, buttons, staples, paper clips, etc. could be used to adjust the circumferential size of the cylindrical wall 12.

A shape-sustaining crown member 32 is secured to the cylindrical wall 12 adjacent the upper section 14 thereof. The shape-sustaining crown member 32 is a generally flat, circularly-shaped disc-like member formed from a relatively heavy gauge or stiffened paper or paper-like material. The disc includes a plurality, preferably four (4), large air-circulating vents 34.

The shape-sustaining crown member 32 is scored along a diameter 36 thereof so as to bisect the disc into two segments 38 and 40 and to facilitate folding of the crown member 32 between a collapsed condition (see FIG. 4) and a shape-sustaining, generally planar condition (see FIGS. 1, 3). Although not essential to sustain the shape of the cylindrical wall 12, it is preferred that both segments of the crown member 32 include a tab member 42 and a cut-out member 44, each of which is positioned along the scored diameter 36 of the disc. The tab members 42 and the cut-out members 44 are correspondingly sized and shaped so that the tab member 42 of one disc segment (either 38 or 40) will frictionally engage the cut-out member 44 of the other disc segment (either 40 or 38) when the crown member 32 is in the shape-sustaining condition.

The shape-sustaining crown member 32 includes integrally formed, radially extending projections 46 at the distal ends of a diameter thereof which is perpendicular to the scored diameter 36. The radial projections 46 are thereby spaced 90° from each end of the scored diameter 36 (see FIG. 3). The projections 46 are adapted to adhesively secure the crown member 32 to the upper portion of the cylindrical wall 12 to thereby fix the circumferential size of the upper wall.

In order to collapse the head covering 10 for storage and transit, said head covering 10 is folded along a pair of fold lines 48 and 50, which lines are defined by a plane perpendicular to the shape-sustaining crown member 32 and through the scored diameter 36 of said crown member 32. Since the projections 46 are located along a portion of the circumference of the shape-sustaining disc spaced approximately 90° from the ends of the scored diameter 36 and since the projections 46 form the only points of attachment between the crown member 32 and the cylindrical wall 12 of the head covering 10, the head covering can be collapsed into a flat condition by folding same along fold lines 48 and 50 while the crown member 36 is folded along the scored diameter 36 thereof.

A user, desirous of wearing a folded disposable head covering 10 of the present invention, applies axial pressure against the underside of the crown member 36 until the tab members 42 frictionally engage the cut-out members 44 to circularly shape the cylindrical wall 12. The user may then adjust the telescoping lower headband 26 to accommodate the size of his head and place the head covering 10 atop his head. Axial inward pressure against the external surface of the crown member 36 will return the head covering 10 to a folded condition for storage.

While one preferred form of the present invention has been described, it is to be understood that the invention may be utilized in other forms and environments, so that the purpose of the appended claims is to cover all such forms of devices not disclosed but which embody the invention disclosed herein.

What is claimed and desired to be secured by Letters Patent of the United States is:

1. A longitudinally elongated, disposable head covering, the head covering defined by a peripheral, cylindrical wall having opposed end sections, a crown member secured to the upper end section, and the lower end section being unobstructed to allow for reception therein of the head of a user; the improvement comprising, in combination:

said crown member being a generally circularly shaped cardboard disc scored along a diameter thereof so as to bisect the disc into two segments and to facilitate folding of said disc between a collapsed condition and a shape-sustaining, generally planar condition; the disc including tab members and cut-out members positioned along the scored diameter thereof, the tab members and cut-out members being correspondingly shaped and sized so that the tab member of one disc segment frictionally engages the cut-out member of the other disc segment when the crown member is in the shape-sustaining condition;

whereby the crown member can be folded upon itself when the head covering is collapsed for storage and shipment, and the crown member can be restored to a generally planar condition to frictionally maintain the cylindrical shape of the head covering when the head covering is worn.

2. A disposable head covering as in claim 1, wherein the cylindrical wall is formed by an inner liner and a corrugated sheet adhesively secured to the outer surface of the liner.

3. A disposable head covering as in claim 1, wherein the crown member includes two radial projections spaced 90° from each end of the scored diameter and which extend from the periphery of the crown member, the projections adapted to secure the crown member to the upper end section of the head covering without interfering with folding of the head covering.

4. A shape-sustaining crown member for a longitudinally elongated, disposable head covering, the head covering defined by a peripheral, cylindrical wall having opposed end sections, a shape-sustaining crown member secured to the upper end section, and the lower end section being unobstructed to allow for reception therein of the head of a user; the improvement comprising in combination:

said crown member being a generally circularly shaped disc scored along a diameter thereof so as to bisect the disc into two segments and to facilitate folding of said disc between a collapsed condition and a shape-sustaining, generally planar condition, the disc including tab members and cut-out members positioned along the scored diameter thereof, the tab members and the cut-out members being correspondingly shaped and sized so that the tab member of one disc segment frictionally engages the cut-out member of the other disc segment when the crown member is in the shape-sustaining condition.

* * * * *